US007353680B1

(12) United States Patent
Huang

(10) Patent No.: US 7,353,680 B1
(45) Date of Patent: Apr. 8, 2008

(54) UNIVERSAL COMPRESSION SPRING FORMER

(76) Inventor: Jin-Tarng Huang, Xialu Rd., Zhongtang, Dongguan, Guangdong (CN)

( * ) Notice: Subject to any disclaimer, the term of this patent is extended or adjusted under 35 U.S.C. 154(b) by 58 days.

(21) Appl. No.: 11/470,602

(22) Filed: Sep. 6, 2006

(51) Int. Cl.
*B21F 3/02* (2006.01)

(52) U.S. Cl. ..... 72/135; 72/17.3; 72/18.6; 72/132; 72/138; 72/145

(58) Field of Classification Search ..... 72/129, 72/132, 135, 138, 140, 143, 145, 17.3, 18.6, 72/19.6, 19.7, 452.8, 441, 446, 454; 140/71 C, 140/103, 124
See application file for complete search history.

(56) References Cited

U.S. PATENT DOCUMENTS 3,641,794 A * 2/1972 Lidert ..... 72/4
4,991,277 A * 2/1991 Itaya ..... 140/71.5
5,713,115 A * 2/1998 Knoepfel et al. ..... 29/33 F
5,829,293 A * 11/1998 Cheng ..... 72/145
5,875,664 A * 3/1999 Scott et al. ..... 72/16.1
6,758,079 B2 * 7/2004 Wells et al. ..... 72/138
7,024,901 B2 * 4/2006 Yamaguchi et al. ..... 72/138

* cited by examiner

*Primary Examiner*—Ed Tolan
(74) *Attorney, Agent, or Firm*—Egbert Law Offices

(57) ABSTRACT

The compression spring former disclosed by the present invention contains an external diameter mechanism, spacing mechanism, wire-feeding mechanism, cutting mechanism, length-detecting mechanism, sorting mechanism, and micro-computer control mechanism. Within the working range, specific springs can be formed simply by inputting the parameters describing the external diameter, spacing, roll number, and other allowance requirements. The control mechanism has a built-in length detecting and automatic sorting mechanism, which can modify the spring spacing according to different free heights, ensuring the allowance of free height. The cutter has a working mode for repeated cutting. The lowest point of the cutter shaft is set to "0" degrees for cutting the springs. If the cutter swings from positive 20 degrees to negative 20 degrees, or from negative 20 degrees to positive 20 degrees, the spring will be cut. That is to say, a spring is produced in every rotation of 40 degrees.

1 Claim, 8 Drawing Sheets

UNIVERSAL COMPRESSION SPRING FORMER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention is related to the technical field of spring forming machinery, and more particularly to an universal compression spring former that can produce specific springs meeting the requirements of overall inspection with just a simple description of spring shape and allowance requirements.

2. Description of Related Art Including Information Disclosed Under 37 CFR 1.97 and 37 CFR 1.98

The spring forming machinery of the prior art requires repeated testing by technicians, and can only form one type of extension spring or compression spring. When special shapes or high precision are needed, the testing would be very time and effort consuming. Sometimes it is simply impossible. The spring forming machinery of the prior art design also has the following drawbacks:

1. Wire-feeding shaft: Only the wire length or scale can be set. There is no way to set the roll number.
2. Cutter shaft (upper cutter or lower cutter): The spring steel wire is cut when the cutter turns a loop. This causes low speed and efficiency.
3. Spacing shaft: The spacing is formed by the push of the cam bit or roller screw. The adjustment of the spacing is realized by testing and is therefore not intuitive.
4. External diameter shaft: The external diameter is adjusted by manually tuning the proportional scale or change of the cam bits. The disadvantages are inconvenient adjustment, low efficiency and demanding technical skill.
5. The prior-art compression spring formers do not have a built-in length detection and sorting device. Owing to steel composition of wire or other factors, the springs produced are unstable when free standing vertically and have to be measured manually one by one. Also, the sorting is performed by human judgment, resulting in inconsistent quality, low acceptance ratio, and low productivity.

BRIEF SUMMARY OF THE INVENTION

The objective of the present invention is to overcome the technical drawbacks of the prior art by providing an universal compression spring former based on the characteristics of spring forming. With a mechanical external diameter means, spacing means, wire-feeding means, cutting means, length-detecting means, and sorting means, such a spring former forms specific springs with guaranteed precision simply by inputting the parameters of the spring shape, such as the external diameter, spacing, roll number, allowance etc. Such a machine not only will greatly enhance productivity, but also can meet the entire requirements of overall inspection.

For the above objectives, the universal compression spring former embodied in the present invention comprises an external diameter means, a spacing means, a wire-feeding means, a cutting means, a length-detecting means, a sorting means, and a control means.

The external diameter means contains a linear cam with a linear variation relationship between its height and angle. The linear cam drives the convergence or expansion of the external diameter control block through the connecting rod, causing the spring external diameter to have a linear change along with the change of the angle of the cam. The linear cam is installed on the external diameter shaft, and the external diameter shaft is connected to the servomotor.

The spacing means causes the change of the spring space to have a linear relationship with the spacing shaft. The spacing rod is controlled by the spacing cam or screw, and the spacing cam or screw is connected to a servomotor.

The wire-feeding means drives the feeding of wire by a wheel set. A control means makes sure that the length of wire feeding is the product of spring intermediate diameter, spring roll number and circumference ratio.

The cutting means has a working mode for repeated cutting. For cutting springs, the lowest point of the cutter is set to "0" degrees, so that the springs will be cut whenever the cutter swings from a positive angle to a negative angle or vice versa, eliminating the need to turn a full circle.

The length-detecting means uses a non-contact sensor to detect the space between the spring and the sensor, so that the control means can detect the actual height of the spring and compare it with the standard height. The spacing of the next spring will be automatically modified. According to the positive or negative allowance requirements, the control means also provides the control signal for the sorting means.

The sorting means is used to receive the springs produced. The sorting device is composed of a normal product chamber, a positive allowance chamber and a negative allowance chamber. The alternate change of the inlets of the three chambers is controlled by an electromagnetic screw or pneumatic device, which is electrically connected to the control means.

The control means is a microcomputer control means, which controls the external diameter means, spacing means, wire-feeding means, and the speed and rotating angle of the servomotor of the cutting means. The screen of the microcomputer displays the input spring parameters, which, after processing by the microcomputer, are transformed to drive commands of corresponding servomotors. The length-detecting means and the sorting means detect the spring height, modify the spacing, and sorting normal product and positive or negative allowance products, so that the entire precision requirements of overall inspection are met.

Compared with the prior art technology, the compression spring former disclosed by the present invention contains an external diameter means, spacing means, wire-feeding means, cutting means, length-detecting means, sorting means, and microcomputer control means.

The compression spring former has the following characteristics:

1. Within the working range, specific springs can be formed simply by inputting the parameters describing the external diameter, spacing, roll number, allowance requirements etc. The manufacturing spring former can form springs just as compiling a computer program, easy and fast.
2. The control means has a built-in length detecting and automatic sorting means, which can modify the spring spacing according to different free heights, ensuring the allowance of free height. The automatic sorting can meet the entire requirements of overall inspection.
3. The cutter is designed with a working mode for repeated cutting. The lowest point of the cutter shaft is set to "0" degrees for cutting the springs. If the cutter swings from positive 20 degrees to negative 20 degrees, or from negative 20 degrees to positive 20 degrees, the spring will be cut. That is to say, a spring is produced in every rotation of 40 degrees. Comparing to the 360 rotation degrees of the prior art machines, the efficiency is enhanced by several times.

DETAILED DESCRIPTION OF THE INVENTION

Embodiments of the present invention will be described below with reference to the accompanying drawings.

As shown in FIGS. 1 to 9, the universal compression spring former embodied in the present invention comprises an external diameter means, spacing means, wire-feeding means, cutting means, length-detecting means, sorting means and control means, all of which are installed on the machine frame through mechanical structures.

The external diameter means contains a linear cam 10, which is connected to the corresponding servomotor through the external diameter shaft. The height and angle of the cam 10 have a linear variation relationship. The linear cam 10 drives the convergence or expansion of the external diameter control block 12 and 13 through the connecting rod 11, causing the spring external diameter to have a linear change along with the change of the angle of the cam 10. The external diameter control block 12 and 13 are interlinked for coordinated movement.

Figure 3:
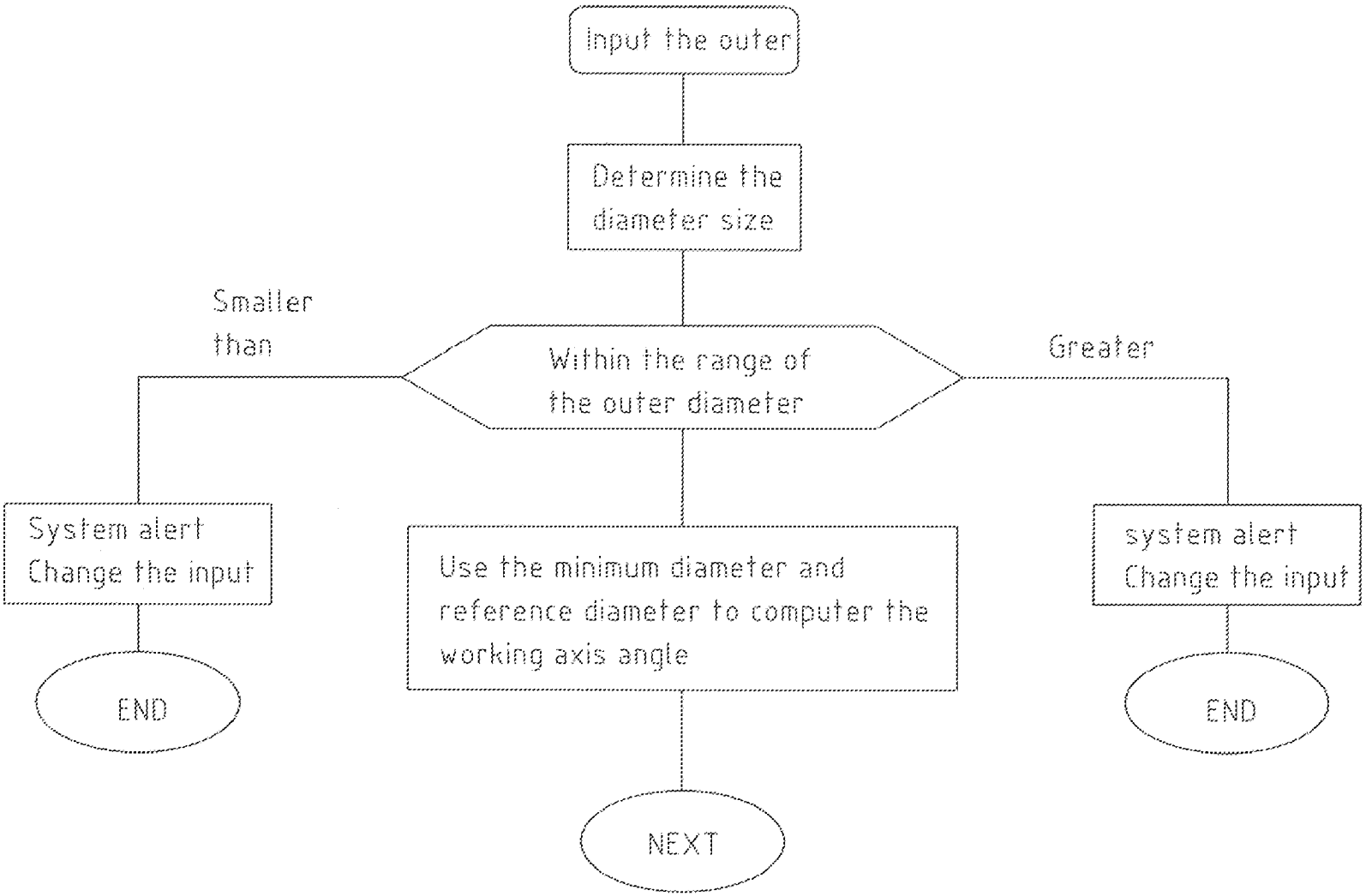
FIG. 3 is a schematic view of a flow chart of the external diameter control.

As described by the Flow Chart of External Diameter Control in FIG. 3, when operating, the zero point of the external diameter shaft is set at the lowest point of the linear cam 10. The controller can revolve the external diameter shaft to set the minimum external diameter (i.e., the base point of external diameter). On another point, after actual measurement, the actual value of the external diameter is input, and the reference external diameter (i.e., the reference point of external diameter) is set. The base point (minimum external diameter) and the reference point (reference external diameter) are also set. Based on the linear relationship in the change of the external diameter, the controller can calculate the external diameter working range, and control the variation of the spring external diameter, without the necessity to pay attention to the mechanical structure.

Figure 1:
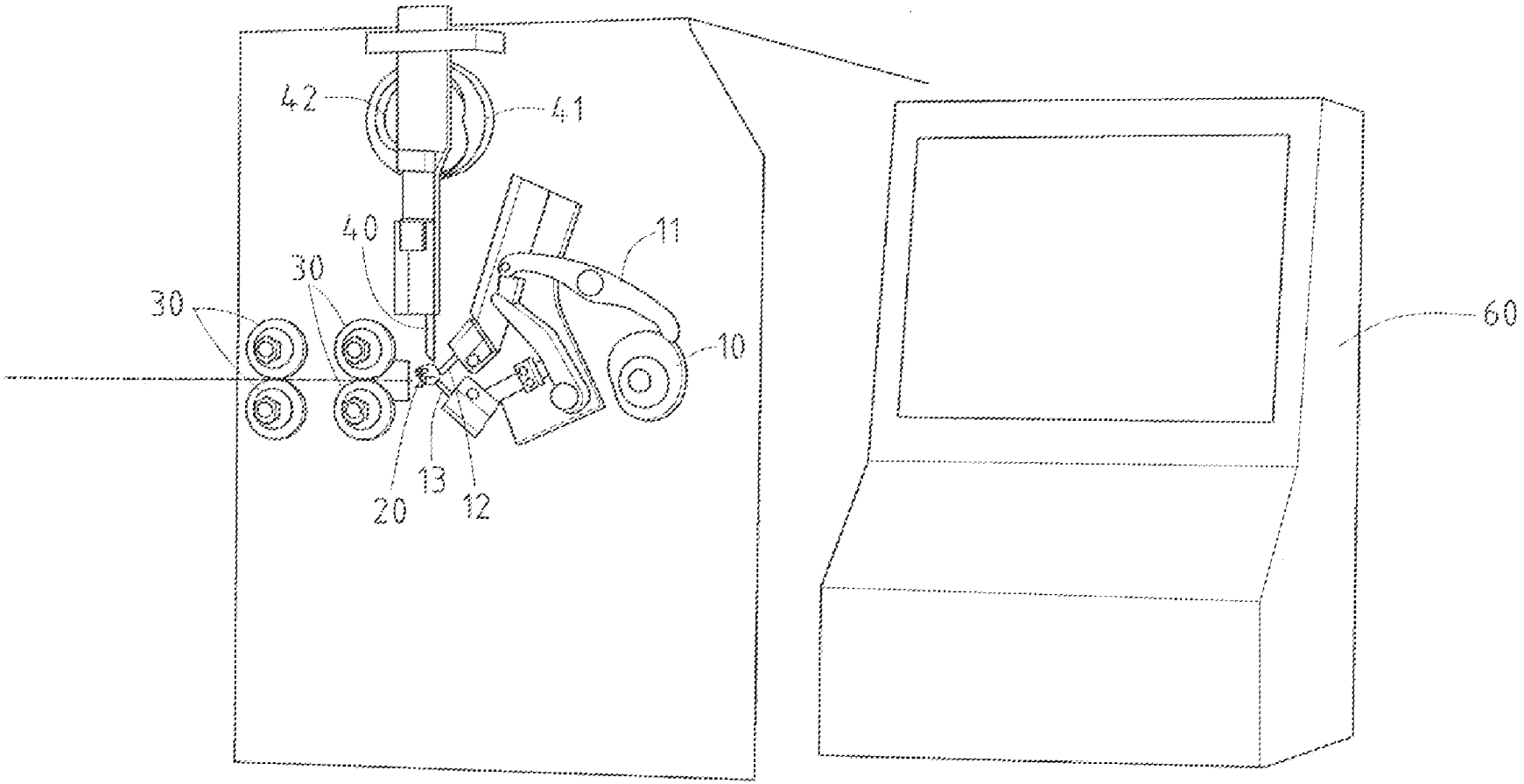
FIG. 1 is a perspective view of an illustration showing a partial structural layout of the present invention.
Figure 2:
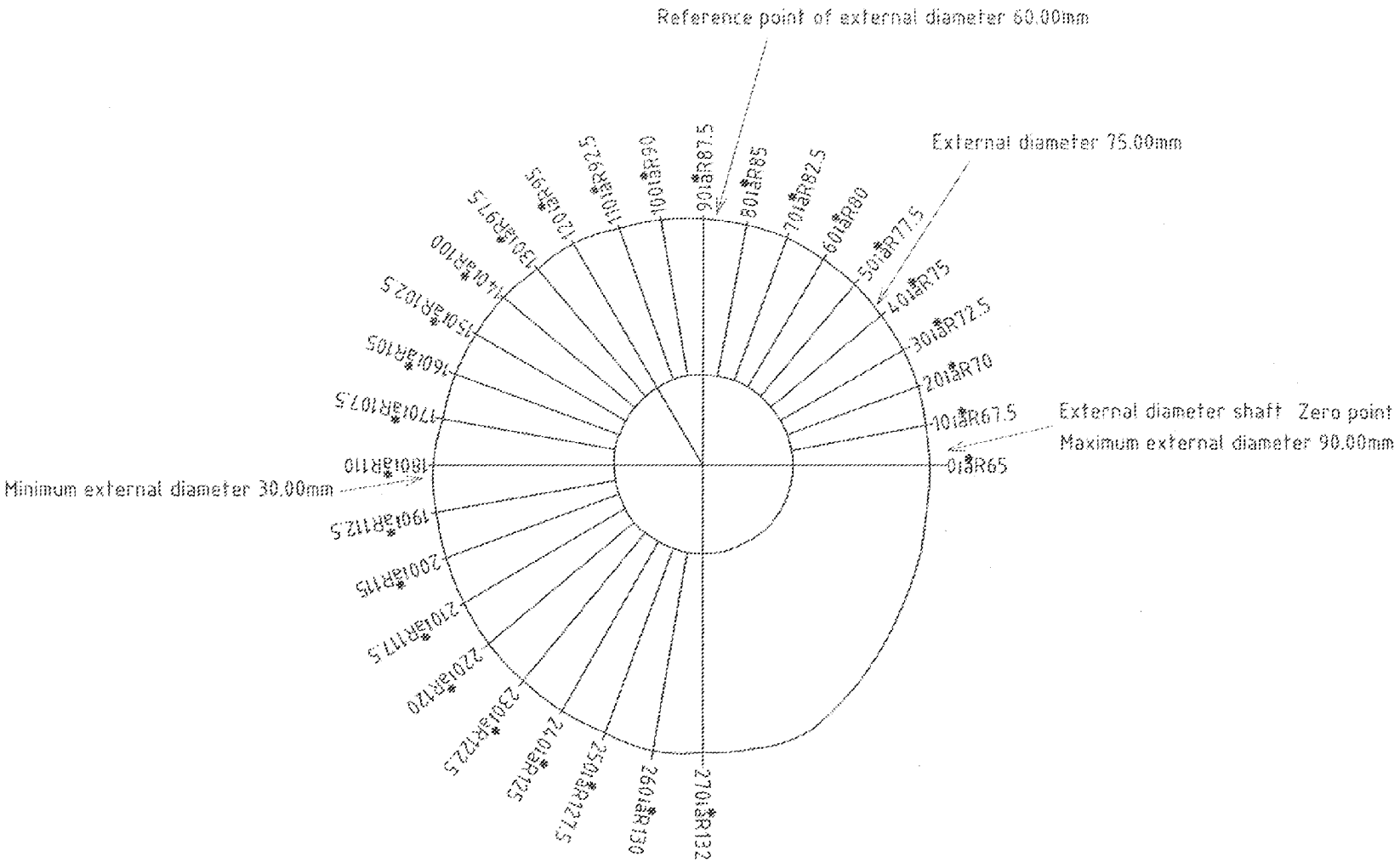
FIG. 2 is a schematic view of a diagram for the setting of one embodiment of the linear external diameter cam.

As shown in FIG. 2, if the minimum angle of the external diameter is set to 180 degrees, the external diameter is 30.00 mm.

If the angle of the external diameter is 90 degrees, the external diameter is 60.00 mm; and the external diameter working range will be 30.00 mm-90.00 mm. If the external diameter is 75.00 mm, the external diameter shaft will turn to the position of 45 degrees.

Figure 4:
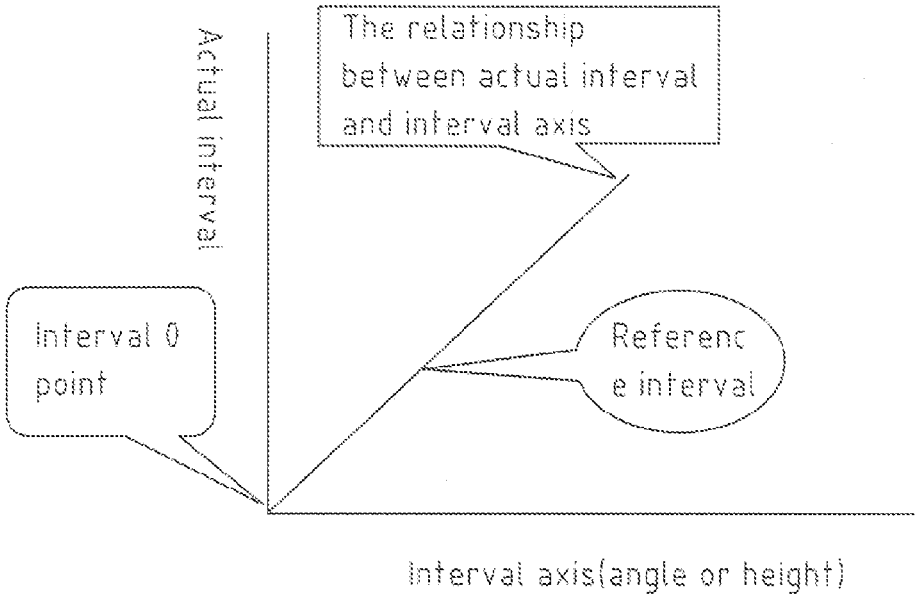
FIG. 4 is a schematic view of a relation schema of the actual spring spacing and the spacing shaft.
Figure 5:
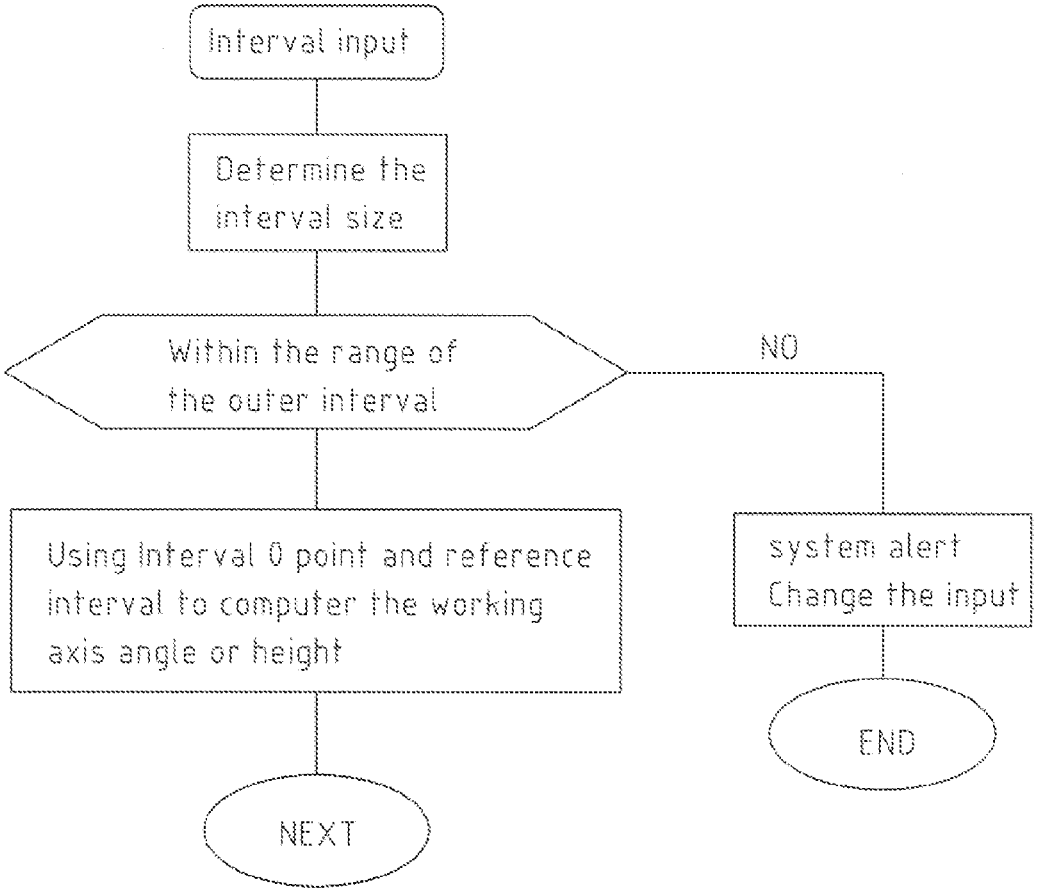
FIG. 5 is a schematic view of a flow chart of the spring spacing control.

The spacing means causes the variation of the spring spacing to have a linear relationship with the spacing shaft, where the spacing rod 20 is controlled by the spacing cam or screw, and the spacing cam or screw is connected to the corresponding servomotor. The controller is operated so that the spacing rod 20 is close to the spring steel wire but not in contact. This position is set as the zero position of spacing (i.e. the base point of spacing). The spacing rod 20 is pushed by the spring steel wire, actually measuring the steel wire spacing, and the actual spacing is input. This position is set as the reference spacing (i.e., the reference point of the spacing). When the base point and reference point are determined, based on the linear relationship of the variation of spacing, the controller can control the servomotor to drive the spacing cam or screw, and control the variation of the spring spacing, without the necessity to pay attention to the mechanical structure. FIG. 4 is a relation schema of the actual spring spacing and the spacing shaft, and FIG. 5 is a flow chart of the spring spacing control showing the simple operation.

The wire-feeding means uses the wheel set 30 to drive the wire feeding. The control means guarantees that the wire feeding length is just the product of a spring intermediate diameter, spring roll number and circumference ratio. Hence, the wire diameter (WD) of the spring shall be input into the controller, so as to calculate the intermediate diameter (OD-WD). The relationships between actual wire feeding length (F), roll number (N), external diameter (OD), and wire diameter (WD) are as follows:

$$F=N*(OD-WD)*3.14(\text{circumference ratio})$$

In the case of varied diameters, the present external diameter and future external diameter can be considered together in the following way:

$$F=N*[(\text{Present } OD-WD)+(\text{Future } OD-WD)]/2*3.14 \text{ (circumference ratio).}$$

The cutting means is designed with a working mode for repeated cutting. The up and down movement of the cutter shaft 40 is driven by a cam 41. A cam slot 42 is configured on the cam 41 for hanging the top of the cutter shaft 40. The lowest point of the cutter is set by the controller for cutting the springs. In the working mode for repeated cutting, when the cutter swings from positive 20 degrees to negative 20 degrees, or vise versa, the spring is cut. That is to say, a spring is cut in every rotation of 40 degrees. Compared to the 360 rotation degrees of the prior art machines, the efficiency of the present invention is enhanced by several times.

The length-detecting means 70 uses a non-contact sensor to detect the spacing between the spring and the sensor, so that the control means can detect the actual height of the spring. Compared with the standard height, the spacing of the next spring is modified. Based on the positive or negative allowance requirements, the control means provides a control signal for the sorting means. The non-contact sensor is installed at the forefront of the spring protrusion. During production, the length-detecting means 70 can detect the free height of the spring, and the non-contact sensor feedback the height difference to the spacing means, so that modification can be made at once and the spacing of the next spring can be adjusted automatically.

Figure 6:
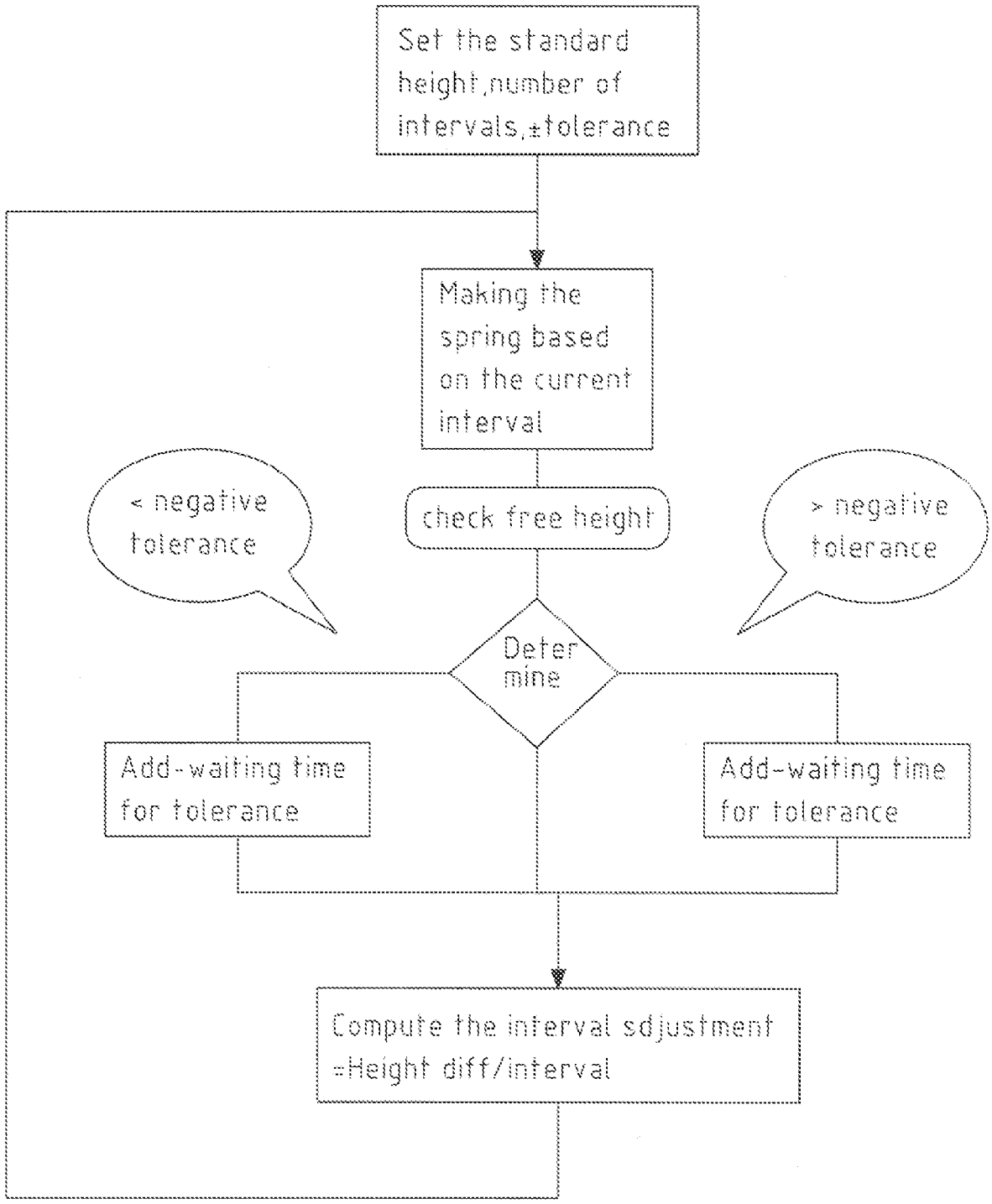
FIG. 6 is a schematic view of a flow chart of the sorting and space modification.

As shown in FIG. 6, after formation of the spring, the length-detecting means 70 detects the free standing height. If it is within the allowance range, the sorting means will maintain in the normal position, and the speed is maintained at the normal production speed, which has no limitation. However, if it is higher than the positive allowance or lower than the negative allowance, the control means will automatic add in a waiting time for the action of the sorting device. Hence, the normal production speed is not affected.

For example:

1. The height of the spring shall be calibrated first to be in accordance with the height displayed.
2. If the height displayed on the screen of the microcomputer is 12.00 mm, it is in accordance with standard height, and the spacing is not modified.
3. The free height is 11.94 mm, 0.06 mm less than the standard height 12.00 mm.
4. If the spacing loop number is 10.00, the spacing of each loop shall be modified by +0.006 mm.
5. If currently the original spacing is 4.005 mm, then the spacing of the next loop shall be modified to 4.011 mm.

Figure 7:
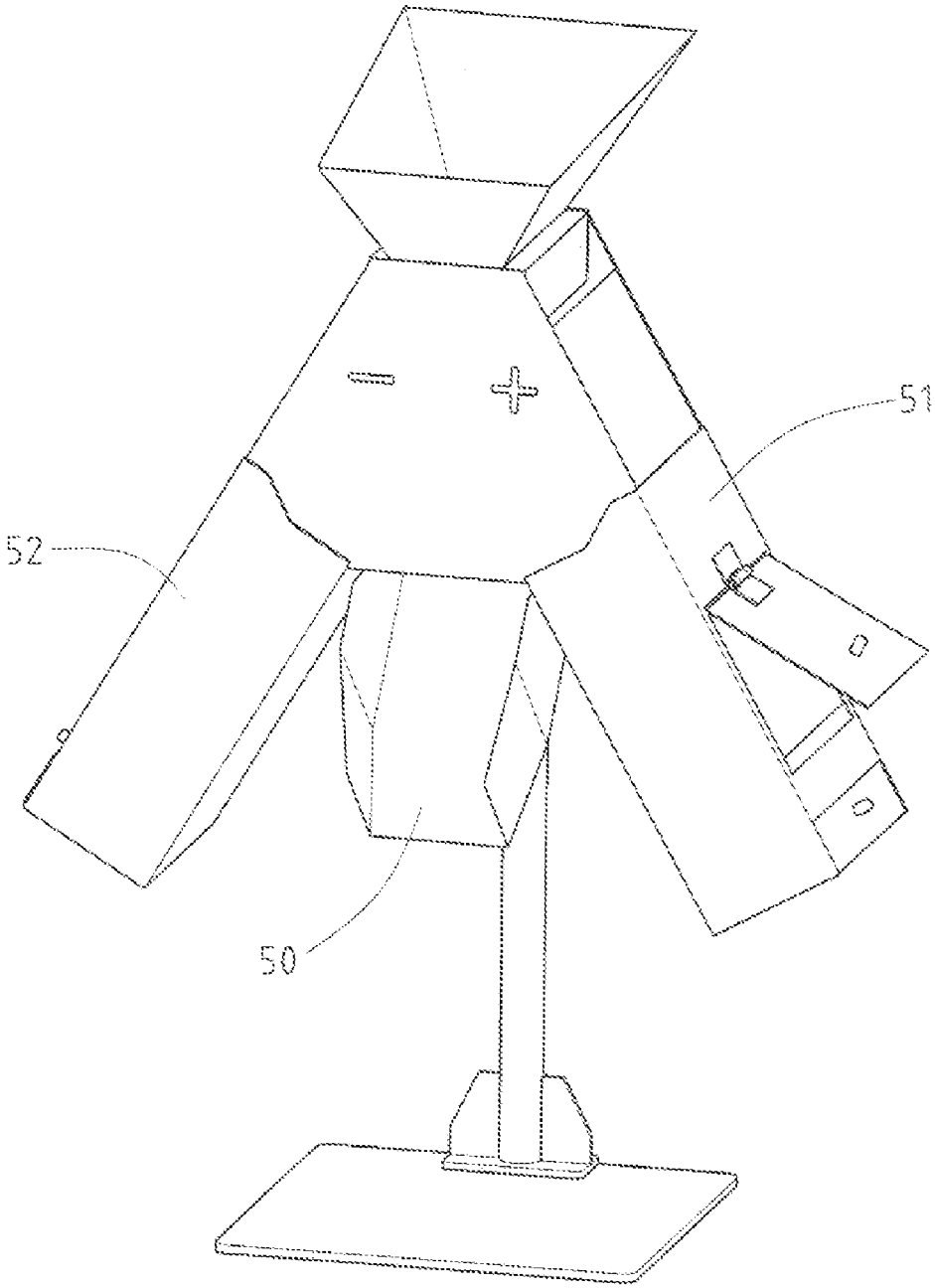
FIG. 7 is a perspective view of an illustration showing the appearance of the sorting mechanism.
Figure 8:
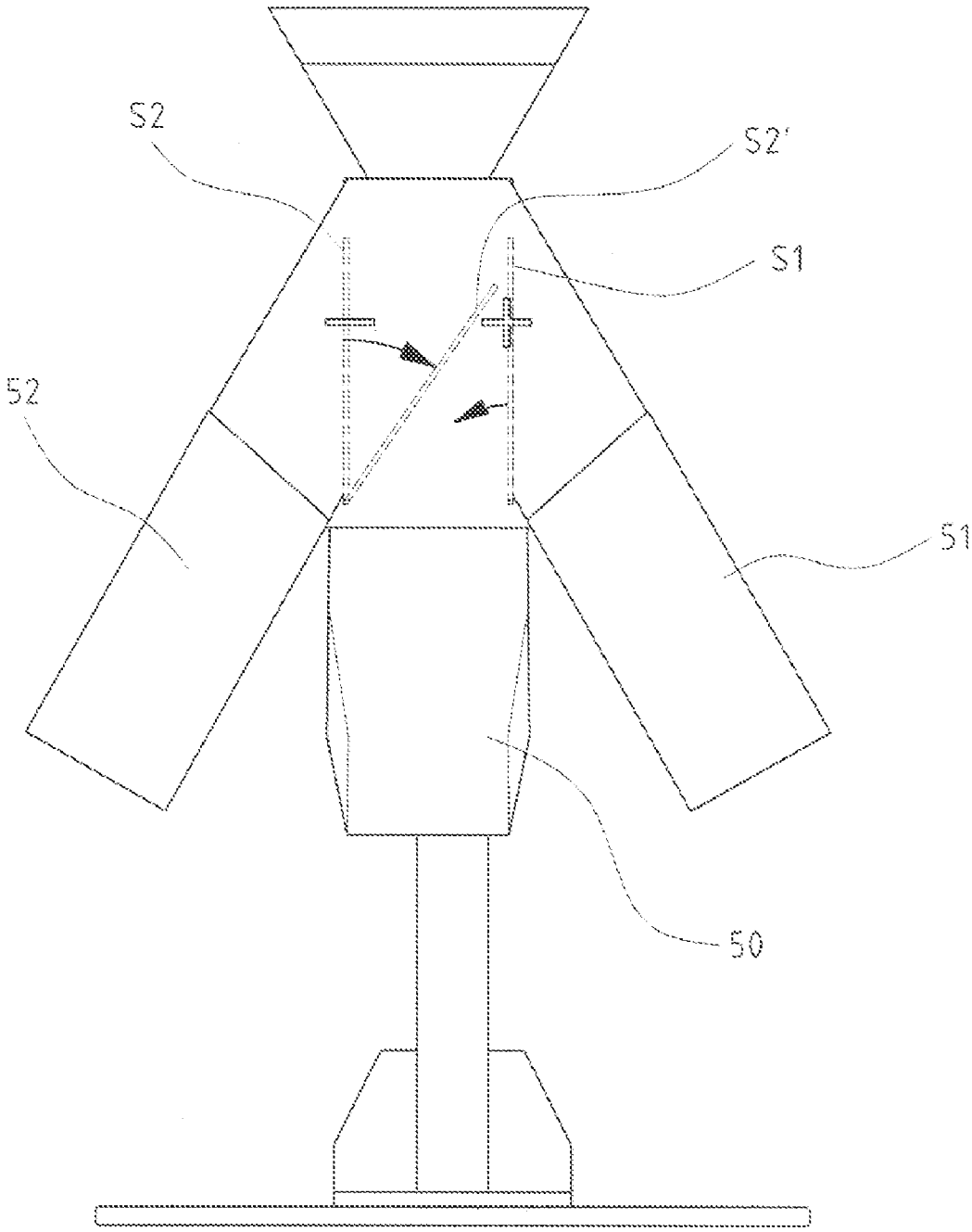
FIG. 8 is an elevation view of an illustration showing the movement of the sorting mechanism.

As shown in FIGS. 7 and 8, the sorting means is composed of a normal product chamber 50, a positive allowance chamber 51 and a negative allowance chamber 52. The alternate change of the inlets of the three chambers is realized by a rotor plate S1 and S2 controlled by an electromagnetic or pneumatic device. The electromagnetic or pneumatic device and the non-contact sensor are both electrically connected to the microcomputer control means 60 of the compression spring former. When the actual height is in conformance with the standard height after the spring formation, the inlet of normal product chamber 50 maintains open to receive the finished products. In case there is a difference between the actual height and the standard height after the spring formation, and if it is higher than the positive allowance range, then the electromagnetic or pneumatic device drives the rotor plate S1 to rotate, shut the inlet of the normal product chamber 50, and open the inlet of the positive allowance chamber 51, to perform positive allowance sorting. After the spring spacing is modified, the inlet of the normal product chamber 50 is open again. If the difference between the actual height and standard height after the spring formation is lower than the negative allowance range, then the electromagnetic or pneumatic device drives the rotor plate S2 to rotate, the inlet of the normal product chamber 50 is shut, and the inlet of the negative allowance chamber 52 is opened, to perform negative allowance sorting. After the spring spacing is modified, the inlet of the normal product chamber 50 is open again. By guaranteeing the free height allowance, automatic sorting realizes 100% conformance of the requirements of overall inspection, eliminates human judgment, enhances efficiency, and maintains stable product quality.

Figure 9:
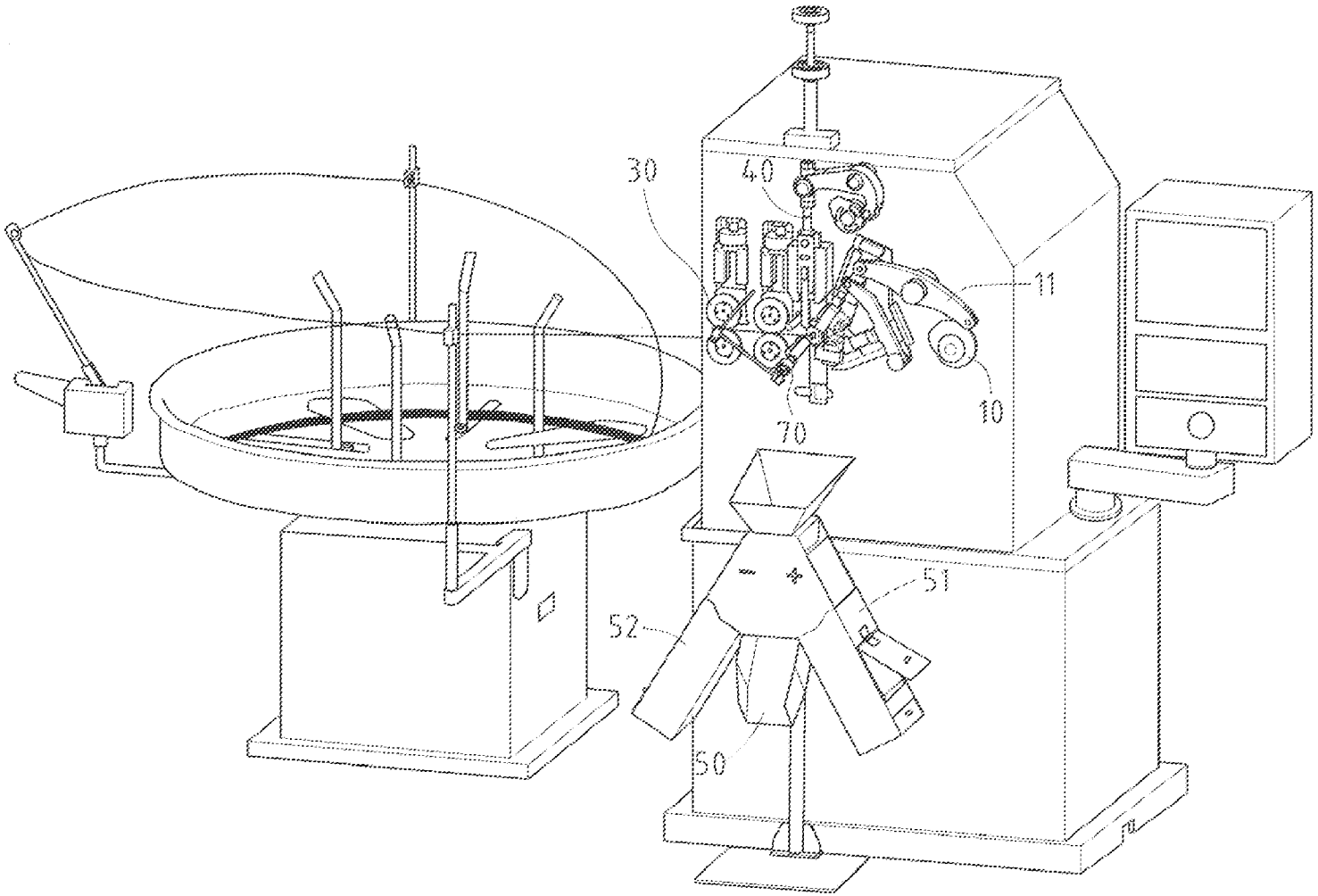
FIG. 9 is a perspective view of an illustration showing the universal compression spring former.

As shown in FIG. 9, the control means is a microcomputer control means 60, which mainly controls the external diameter means, spacing means, wire-feeding means, and the speed and rotating angle of the servomotor of the cutting means. The screen of the microcomputer displays the input spring parameters, which, after processing by the microcomputer, are transformed to drive commands of corresponding servomotors. The length-detecting means and the sorting means detect the spring height, modify the spacing, and sort normal product and positive or negative allowance products. Thus, the entire precision requirements of overall inspection are met. In this way, all requirements of the universal compression spring former are met. Specific springs can be formed simply by inputting the spring parameters such as external diameter, spacing, roll number, allowance requirements etc. The manufacturing spring former can form springs just as compiling a computer program, easy and fast.

I claim:

1. An universal compression spring former, comprising:

an external diameter means being comprised of a linear cam with a linear variation relationship between height and angle thereof, said linear cam driving a convergence or expansion of an external diameter control block through a connecting rod, causing external diameter of a spring to have a linear change along with a change of angle of said linear cam, said linear cam being installed on an external diameter shaft, said external diameter shaft being connected to a servomotor;

a spacing means causing change of space of said spring to have a linear relationship with a spacing shaft, a spacing rod being controlled by a spacing cam or screw, said spacing cam or screw being connected to a servomotor;

a wire-feeding means driving a feeding of wire by a wheel set and having a control means to ensure length of wire feeding as a product of spring intermediate diameter, spring roll number and circumference ratio;

a cutting means with a working mode for repeated cutting, a lowest point of said cutting means being set to zero degrees for cutting said spring, said spring being cut whenever a cutter of said cutting means swings from a positive angle to a negative angle or vice versa;

a length-detecting means using a non-contact sensor to detect space between said spring and said sensor, a control means detecting actual height of said spring and comparing said spring with standard height spacing of a next spring being automatically modified, said control means providing a control signal for a sorting means according to the positive or negative allowance requirements; and a sorting means receiving springs produced and being comprised of a normal product chamber, a positive allowance chamber and a negative allowance chamber, an alternate change of inlets of the three chambers being controlled by an electromagnetic screw or pneumatic device electrically connected to said control means;

wherein said control means is comprised of a microcomputer control means, controlling said external diameter means, spacing means, wire-feeding means, and speed and rotating angle of the servomotor of said cutting means, a screen of the microcomputer displaying input spring parameters, said spring parameters being transformed to drive commands of corresponding servomotors after processing by the microcomputer, using the feedback data of spring height from said length-detecting means, spacing of the next spring being modified.

* * * * *